United States Patent [19]

Diamond

[11] Patent Number: 4,635,619

[45] Date of Patent: Jan. 13, 1987

[54] WATER MASSAGER MEANS

[76] Inventor: Harvey E. Diamond, 12953 Woodbridge St., Studio City, Calif. 91604

[21] Appl. No.: 572,699

[22] Filed: Jan. 20, 1984

[51] Int. Cl.[4] ..... A61H 23/04

[52] U.S. Cl. ..... 128/39; 128/33; 128/53; 128/66

[58] Field of Search ..... 128/24 R, 33, 38, 39, 128/40, 44, 53, 66

[56] References Cited

U.S. PATENT DOCUMENTS

| | | | |
|---|---|---|---|
| 2,604,758 | 7/1952 | Swindler | 128/24 R |
| 2,938,517 | 5/1960 | Friend | 128/66 |
| 3,464,405 | 9/1969 | Kallus | 128/33 |
| 3,477,424 | 11/1969 | Tracy | 128/66 |
| 3,772,714 | 11/1973 | Sealby | 128/66 |

FOREIGN PATENT DOCUMENTS

| | | | |
|---|---|---|---|
| 60206 | 9/1982 | European Pat. Off. | 128/40 |
| 2161678 | 6/1973 | Fed. Rep. of Germany | 128/66 |
| 2604511 | 8/1977 | Fed. Rep. of Germany | 128/44 |
| 797482 | 2/1936 | France | 128/38 |
| 1521497 | 3/1968 | France | 128/40 |
| 2321874 | 3/1977 | France | 128/40 |

*Primary Examiner*—Clyde I. Coughenour
*Attorney, Agent, or Firm*—I. Morley Drucker

[57] ABSTRACT

The invention relates to a novel enclosure means containing, or adapted to contain, a fluid pathway or channel. A fluid nozzle or jet is adapted to be affixed to an entry port to said fluid pathway. The nozzle, or jet, can be connected to a source of water, or water and air, as in a whirlpool jet. A fluid stream entering the fluid pathway is directed onto a flexibly resilient portion, or diaphragm, of the enclosure means, and after contacting the said diaphragm, is removed from the enclosure means. The rate of inflow to outflow of fluid is equalized so fluid build-up in the enclosure means is avoided.

The fluid stream impinging on the diaphragm, and thereafter being removed, imparts a vibratory action on the diaphragm which gives rise to a massaging effect on the neck or other part of the anatomy resting on the enclosure means.

The enclosure means is preferably placed or supported on a whirlpool bathtub ledge or support so that connections to a source of fluid, under pressure, is readily available.

11 Claims, 5 Drawing Figures

Fig. 1
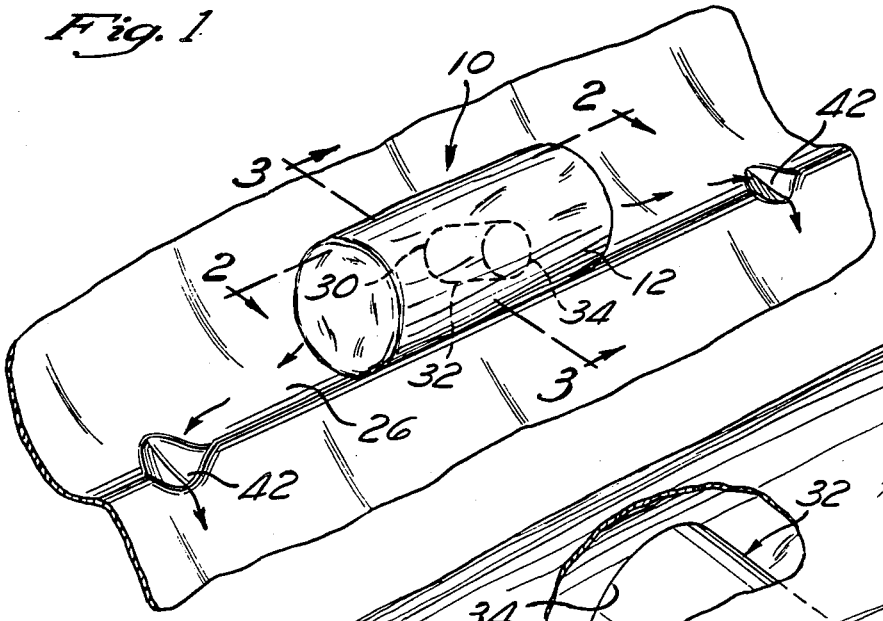
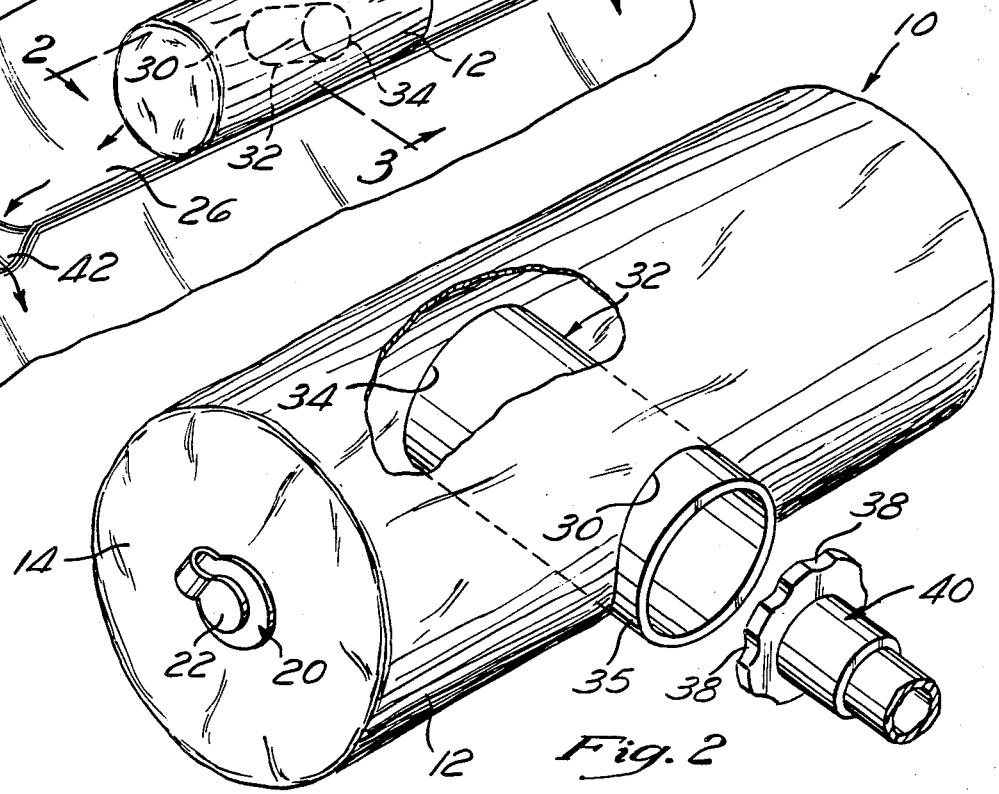
Fig. 2
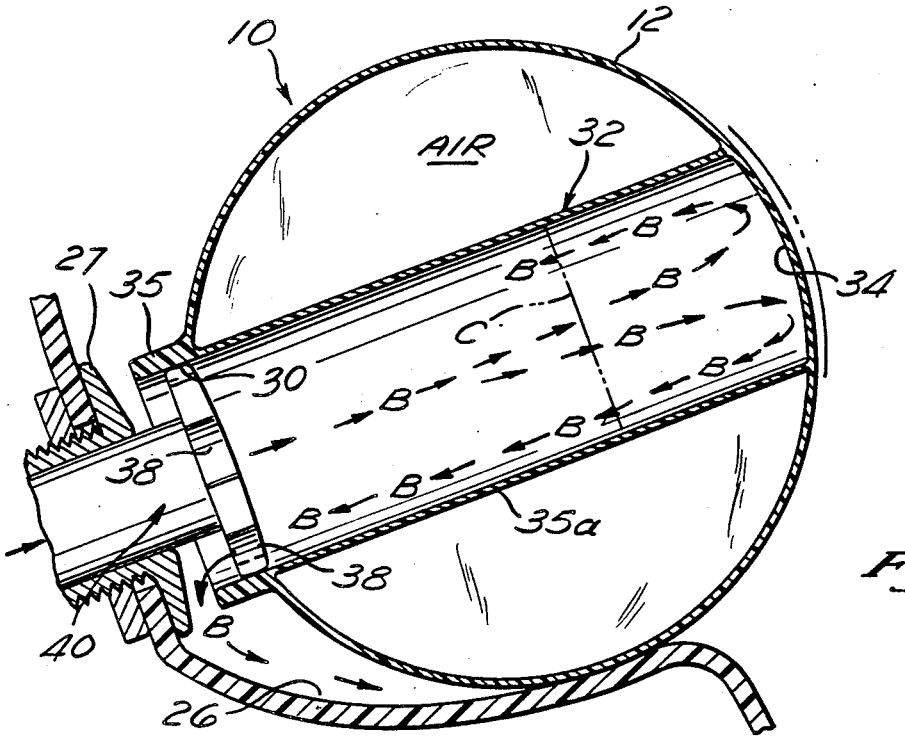
Fig. 3

Fig. 4
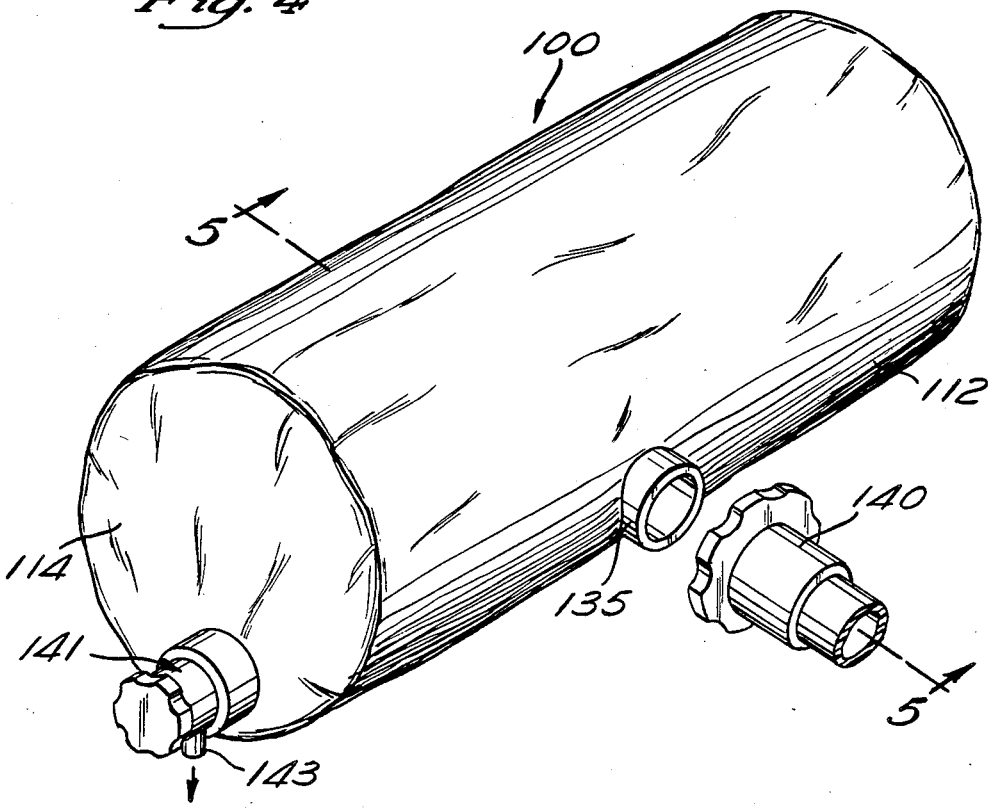
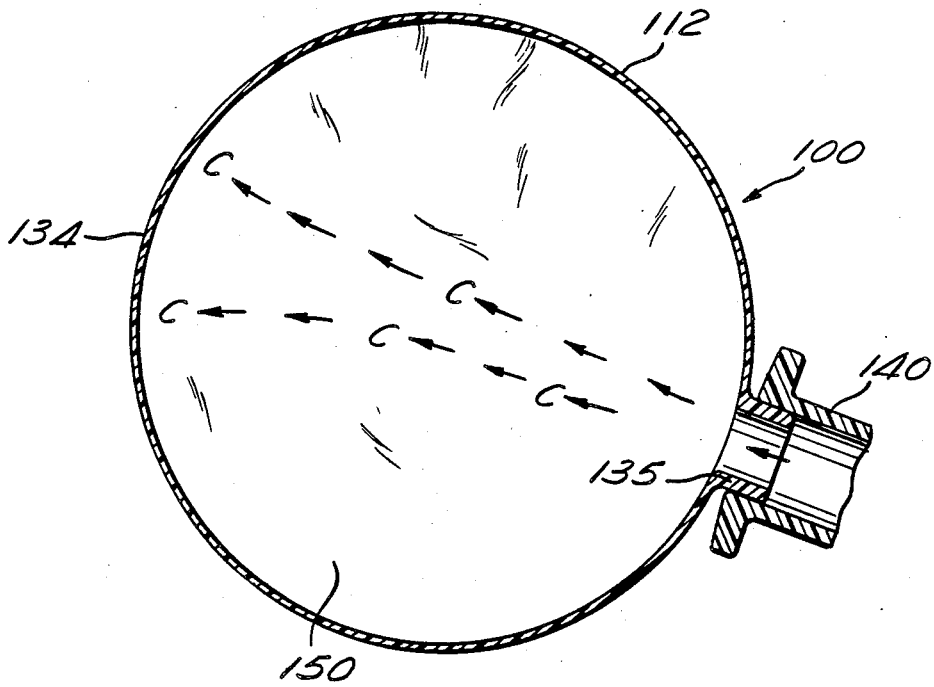
Fig. 5

WATER MASSAGER MEANS

BRIEF SUMMARY OF THE INVENTION

The invention relates to a novel preferably air-inflated enclosure means containing, or adapted to contain, a fluid pathway or channel. A fluid nozzle or jet is adapted to be affixed to an entry port to said fluid pathway. The nozzle, or jet, can be connected to a source of water, or water and air, as in a whirlpool jet. A fluid stream entering the fluid pathway is directed onto a flexibly resilient portion, or diaphragm, of the enclosure means, and after contacting the said diaphragm, is removed from the enclosure means. The rate of inflow to outflow of fluid is equalized so fluid build-up in the enclosure means is avoided.

The fluid stream impinging on the diaphragm, and thereafter being removed, imparts a vibratory action on the diaphragm which gives rise to a massaging effect on the neck or other part of the anatomy resting on the enclosure means.

The enclosure means is preferably placed or supported on a whirlpool bathtub ledge or support so that connection to a source of fluid, under pressure, is readily available. The enclosure means is preferably oriented so that the entering fluid stream is directed upwardly, through a fluid pathway or channel, or to the upper, diaphragm area of the enclosure and immediately removed from the said diaphragm area, and from the enclosure means, to be finally drained into the bathtub proper.

BRIEF DESCRIPTION OF THE DRAWINGS

FIG. 1 is a fragmentary perspective view of a first embodiment of the massaging enclosure means of the invention shown resting on a portion of a bathtub wall or the like;

FIG. 2 is a perspective view of said first embodiment of the massage enclosure means shown in FIG. 1, as viewed along line 2—2 of FIG. 1;

FIG. 3 is a cross-sectional view taken along line 3—3 of FIG. 1;

FIG. 4 is a perspective view of a second embodiment of the invention; and

FIG. 5 is a cross-sectional view taken along line 5—5 of FIG. 4.

DETAILED DESCRIPTION OF THE INVENTION

A first, and presently preferred embodiment is shown in FIGS. 1-3. An air-inflated enclosure means is there generally designated by the numeral 10. The enclosure means is preferably primarily formed of a thin-walled flexibly resilient plastic (e.g., PVC) and is preferably shaped in the form of a cylinder having an elongated endless tubular wall 12 closed at its ends by end walls 14. One of the end walls 14 of the enclosure means 10 is provided, preferably, with an air inlet port 20, having a conventionally hinged flap closure 22 for opening and closing the air inlet to the enclosure means 10.

The enclosure means 10 is shown in FIGS. 1 and 3 as resting on a curved support ledge 26, which is preferably part of a bathtub or other support means close to a source of water.

The enclosure means 10 is provided with, a preferably circular fluid opening or entry port means 30, which in the FIGS. 1 and 3 orientation of the enclosure means 10 lies in the lower portion of the enclosure means 10.

The entry port means 30 has, provided in fluid-tight engagement therewith a preferably tubular channel or endless wall 32, preferably having an outwardly extending lip 35, and a tubular portion 35*a* extending into the enclosure means 10, preferably to a diaphrragm area 34 which lies at, a relatively upper, remote surface area of the enclosure wall 12. The diaphragm area 34, is made of thin, flexibly resilient plastic material, is very responsive to changes in water or water and air pressure—and results in vibratory motion being imparted to the diaphragm area 34 and surrounding areas. The inner portion of channel 32 may also terminate short of diaphragm area 34, as at phantom line C, i.e., may terminate proximate to area 34, within the interior of enclosure means 10.

The tubular channel 32 is preferably formed of a rigid plastic—although it could also, less preferably, be formed of a flexibly resilient plastic similar to, or the same as, the material of the enclosure means 10. The channel 31 is fluid-tight at the point of its connections to the enclosure wall 12.

The operation of the enclosure means 10, for massage, will now be described.

The enclosure means 10 is first air-inflated through port 20, and in those instances where the walls of tubular channel 32 are formed of flexibly resilient material, the air-inflated enclosure 10 will define the tubular channel 32. Care must be taken not to over-inflate the enclosure means 10 if channel 32 does not comprise a rigid wall.

A fluid nozzle or air/water jet 40 normally provided in a whirlpool type of bath and rigidly affixed to a portion of the supporting wall 26 by means of a flange head 27 (as best shown in FIG. 3), is affixed within the lip extension 35 of the tubular channel 32. The jet 40 is connected to a source water and/or air under pressure. The effluent water stream B from the jet is directed upwardly onto the wall surface diaphragm area 34, and after contact, the spent fluid drains from the enclosure 10, by gravity, through the fluid entry port 30—through scalloped openings 38 of the jet 40.

The spent fluid, after draining from enclosure 10, as described, flows through drain channels or grooves 42 formed in ledge 26, to the bathtub or other main outlet.

The fluid stream emanating from the jet 40 may be a continuously rotating flow, or may be a simple, continuous stream of water, or water/air stream. All such fluid streams are adjustable in their rate and pattern of flow.

The fluid stream impinges on flexibly resilient surface diaphragm area 34 of enclosure 10 and thereby imparts a gentle, vibratory action to the diaphragm area 34. It is this vibratory action which may be transmitted to a portion of the anatomy of a user and which is responsible for the massaging action.

The tubular channel 32 need not be cylindrical in shape. A channel, formed in the shape of a dual-truncated cone, would be equally operable.

An enclosure means 100 is shown in a second embodiment of FIGS. 4 and 5, which embodiment is of somewhat simpler construction than the first (FIGS. 1-3) embodiment. The principles of operation are the same as in the first embodiment.

More particularly, enclosure 100 is preferably formed of a flexibly resilient plastic material. The enclosure 100 is preferably tubular in shape, having a tubular side wall 112 and generally planar end walls 114.

A fluid entry port means 135 is provided in the lower portion of the enclosure 100 (when placed in the normal orientation shown in FIG. 5) to which may be connected a source of fluid, under pressure, e.g., a jet 140 of the same type as jet 40.

In the FIGS. 4–5 embodiment, fluid will be directed from jet 140 to a wall area remote from the fluid entry port, as indicated by arrows C, causing a vibratory action at the area of contact 134. The spent fluid will drain in this embodiment, through a valve 141, having an exit orifice 143. Valve 141 is adustable, and is adjusted to substantially equalize the inflow from jet 140 in order to prevent any material build-up of fluid in enclosure 100. Fluid entry port 135 has no drain capability; it is utilized only for fluid entry.

While the FIGS. 4–5 embodiment may be simpler and cheaper to construct, and transmits vibratory action to the diaphragm enclosure walls in an efficient manner—when the jet is turned off, fluid 150 will remain in the enclosure and will have to be manually drained therefrom. This may be deemed to be an inconvenience.

Various modifications will suggest themselves to those skilled in the art. Hence, I intend to be bound only by the claims which follow.

I claim:

1. A fluid-tight flexibly resilient enclosure for enabling a person's head to be supported thereon and for enabling a vibratory massage to be applied to the person's head, which enclosure is adapted to be inflated and to be supported on a supporting surface, and is further adapted to be connected to a valve-controlled pressurized stream of fluid so as to direct such pressurized fluid stream against the portion thereof on which the person's head is to be supported and so as to remove such fluid from the enclosure at substantially the same rate at which such fluid stream is directed thereinto, to prevent any material fluid buildup, and to generate the vibratory massage, comprising:

(a) an outer enclosing wall, adapted to be inflated, including a lower portion adapted to be supported on the supporting surface, which includes a fluid port formed therein, adapted to be connected to the valve-controlled pressurized stream of fluid, and an upper portion, opposite the lower portion, adapted to project from the supporting surface and to enable the person's head to be supported thereon; and (b) a hollow inner generally tubular shaped wall, having a through passage, which extends from the fluid port in the lower portion of the outer wall, into the outer wall, so as to direct fluid from the fluid port into the outer wall for impinging directly on the upper portion of the outer wall and for enabling removal of such fluid therethrough to prevent material fluid buildup and to generate the vibratory massage to be applied to the person's head to be supported on the upper portion of the outer wall.

2. The enclosure of claim 1 wherein said enclosure is made of a plastic material.

3. The enclosure of claim 1 wherein said enclosure has a narrow cylindrical shape.

4. The enclosure of claim 1 wherein said first fluid port comprises an alongated cylinder with a rigid wall extending into said enclosure.

5. The enclosure of claim 1 wherein the hollow inner wall comprises a rigid wall cylinder extending into the enclosure and terminating at the upper wall area in a fluid-tight seal, and further comprising a second port means provided in a surface portion of the remainder of the enclosure, adapted to communicate with an air source.

6. The enclosure of claim 1 in which the pressurized fluid stream comprises a high pressure stream of admixed water and air to the fluid port.

7. The enclosure of claim 1 in which the pressurized fluid stream comprises a high pressure continuously rotating stream of admixed water and air.

8. An enclosure as in claim 1, in which the hollow inner wall is cylindrical-shaped.

9. An enclosure as in claim 1, in which the hollow inner wall is comprised of flexible material.

10. An enclosure as in claim 1, in which the hollow inner wall extends through the outer wall and terminates in a fluid-tight seal at the upper portion of the outer wall.

11. An apparatus for enabling a person's head to be supported thereon and for enabling a vibratory massage to be applied to the person's head, which apparatus is adapted to be supported on a supporting surface, and is further adapted to be connected to a valve-controlled pressurized stream of fluid so as to direct such pressurized fluid stream against the portion thereof on which the person's head is to be supported and so as to remove such fluid from the apparatus at substantially the same rate at which such fluid stream is directed thereinto, to prevent any material fluid buildup, and to generate the vibratory massage, comprising:

(a) a fluid-tight flexibly resilient enclosure, adapted to be inflated, including a lower portion adapted to be supported on the supporting surface, which includes a fluid port formed therein adapted to be connected to the valve-controlled pressurized stream of fluid, an upper portion opposite the lower portion, adapted to project from the supporting surface and to enable the person's head to be supported thereon, and a hollow generally tubular shaped inner wall, having a through passage, which extends from the fluid port in the lower portion of the enclosure, into the enclosure, so as to direct fluid from the fluid port into the enclosure for impinging directly on the upper portion of the enclosure and for enabling removal of such fluid therethrough to generate the vibratory massage to be applied to the person's head to be supported on the upper portion thereof; and (b) means, connected to the fluid port of the enclosure, for enabling a valve-controlled pressurized stream of fluid to be directed into the enclosure, through the fluid port and through the hollow inner wall of the enclosure, so as to impinge directly on the upper wall area of the enclosure to generate vibratory massage, and to further enable such fluid to be removed from the enclosure through the hollow inner wall and through the fluid port thereof at a rate substantially the same as the rate at which fluid is directed into the enclosure, to prevent material fluid buildup in the enclosure and to generate vibratory massage, comprising a fluid nozzle which has a central opening therein through which the pressurized fluid stream is directed, and a flange at the end thereof which includes peripheral scalloped outer circle-segments, at which flange the fluid nozzle is adapted to be connected to the enclosure fluid port, such that fluid is removed from the enclosure through the outer circle-segments of the fluid nozzle flange.

* * * * *